US010213812B2

(12) United States Patent
Thompson et al.

(10) Patent No.: US 10,213,812 B2
(45) Date of Patent: Feb. 26, 2019

(54) METHOD AND DEVICE TO REMOVE A CONTAMINANT FROM A MATERIAL

(71) Applicant: Transition Solutions Limited, Sheffield, South Yorkshire (GB)

(72) Inventors: Steve Thompson, Sheffield (GB); David Ingall, Sheffield (GB)

(73) Assignee: Transition Solutions Limited, Sheffield, South Yorkshire (GB)

( * ) Notice: Subject to any disclaimer, the term of this patent is extended or adjusted under 35 U.S.C. 154(b) by 0 days.

(21) Appl. No.: 15/569,250

(22) PCT Filed: Apr. 29, 2016

(86) PCT No.: PCT/GB2016/051263
§ 371 (c)(1),
(2) Date: Oct. 25, 2017

(87) PCT Pub. No.: WO2016/174479
PCT Pub. Date: Nov. 3, 2016

(65) Prior Publication Data

US 2018/0117638 A1 May 3, 2018

(30) Foreign Application Priority Data

Apr. 30, 2015 (EP) ..... 15166097

(51) Int. Cl.
*B08B 3/02* (2006.01)
*B08B 3/04* (2006.01)
(Continued)

(52) U.S. Cl.
CPC ..... *B08B 3/041* (2013.01); *B03B 5/00* (2013.01); *B08B 3/02* (2013.01); *B08B 3/102* (2013.01);
(Continued)

(58) Field of Classification Search
None
See application file for complete search history.

(56) References Cited

U.S. PATENT DOCUMENTS

| | | | |
|---|---|---|---|
| 2,790,750 | A | 4/1957 | Eyre |
| 2,825,677 | A | 3/1958 | Coulson |
| 4,326,953 | A | 4/1982 | Gibby et al. |
| 4,626,360 | A | 12/1986 | Senyard, Sr. et al. |
| 5,296,153 | A | 3/1994 | Peachey |

(Continued)

FOREIGN PATENT DOCUMENTS

| | | | |
|---|---|---|---|
| CN | 102659211 | A | 9/2012 |
| CN | 202729851 | U | 2/2013 |

(Continued)

OTHER PUBLICATIONS

International Search Report and Written Opinion dated Aug. 4, 2016 for International Application No. PCT/GB2016/051263.

*Primary Examiner* — Eric W Golightly
(74) *Attorney, Agent, or Firm* — Patterson + Sheridan, LLP

(57) ABSTRACT

A method to remove a contaminant from a material comprises using a drive mechanism to provide a plurality of portions of material to a nozzle in order to generate a jet of the portions of material from the nozzle. At least some of the portions of material are at least partially coated in a contaminant. The jet of the portions of material are directed at a surface of a volume of liquid. An interaction between the jet of the portions of material and the surface of the volume of liquid causes at least some of the contaminant to detach from at least some of the portions of material.

12 Claims, 3 Drawing Sheets

(51) Int. Cl.

| | |
|---|---|
| ***B03B 5/00*** | (2006.01) |
| ***B08B 3/10*** | (2006.01) |
| ***B08B 3/14*** | (2006.01) |

(52) U.S. Cl.
CPC ..... *B08B 3/14* (2013.01); *B08B 2203/0252* (2013.01)

(56) References Cited

U.S. PATENT DOCUMENTS

| | | | | |
|---|---|---|---|---|
| 5,341,539 | A * | 8/1994 | Sheppard | B08B 9/027 134/168 C |
| 5,879,541 | A | 3/1999 | Parkinson | |
| 6,074,549 | A | 6/2000 | Bacon Cochrane et al. | |
| 6,082,452 | A | 7/2000 | Shaw et al. | |
| 6,527,960 | B1 * | 3/2003 | Bacon | B01D 17/0214 210/741 |
| 2002/0153326 | A1 | 10/2002 | Oddie | |
| 2003/0168391 | A1 | 9/2003 | Tveiten | |
| 2006/0016760 | A1 | 1/2006 | Bozak et al. | |
| 2007/0227564 | A1 | 10/2007 | Costinel | |
| 2013/0134108 | A1 | 5/2013 | Howard | |
| 2013/0193048 | A1 | 8/2013 | Theegala | |
| 2014/0053829 | A1 | 2/2014 | Lee | |

FOREIGN PATENT DOCUMENTS

| | | | |
|---|---|---|---|
| CN | 103087812 | A | 5/2013 |
| JP | 2002336731 | A | 11/2002 |
| WO | 8501884 | A1 | 5/1985 |
| WO | 9942218 | A1 | 8/1999 |
| WO | 04004863 | A1 | 1/2004 |

* cited by examiner

METHOD AND DEVICE TO REMOVE A CONTAMINANT FROM A MATERIAL

FIELD OF THE INVENTION

The present invention relates to a method and device to remove a contaminant from a material.

BACKGROUND OF THE INVENTION

Many manufacturing processes produce a large quantity of waste material.

For example, machining materials typically produces large quantities of waste material in the form of swarf, such as the waste metal shavings produced when milling a metal block. The swarf tends to be contaminated with cutting fluid, lubricant, cooling fluid, grease or any other product that was used during the machining process.

As another example, millscale, an iron oxide residue left on the surface of hot rolled steel which must be removed before the steel can be used, is a waste material produced in large quantities in steel manufacture. The millscale tends to become contaminated with oil, grease and other contaminants used during the removal of the millscale or the processing of the steel.

There are economic and environmental motivations for trying to recycle waste material into new material for reuse. The economic motivations include the facts that many materials, particularly metals, are expensive so dumping waste material is wasting a potentially valuable resource, and there are also significant costs involved in waste disposal. The environmental motivations include the facts that dumping the waste material is a waste of limited resources, unnecessarily fills waste disposal sites and leads to potential pollution from both the waste material and the contaminants. Dumping waste material also means that it is necessary to extract further new material with an associated environmental impact involved in extracting new material.

Before recycling waste material into new material, it is necessary to remove contaminants from the waste material to prevent the contaminants from contaminating the new material. However, it is difficult to remove contaminants from waste material.

Existing method of cleaning contaminants from waste material use detergents (which are inefficient), organic solvents such as trichloroethylene (which are toxic, environmentally unfriendly, and whose use is heavily legally regulated), or heat (which is expensive because of the large quantities of fuel, such as gas, required).

Despite the economic and environmental benefits to recycling waste material, there is currently no cost effective, reliable and environmentally friendly way of removing contaminants from waste material which means that most waste material is dumped rather than recycled.

It is therefore desirable to find a cost effective, reliable and environmentally friendly way to remove contaminants from waste material.

SUMMARY OF THE INVENTION

According to a first aspect of the invention, there is provided a method to remove a contaminant from a material. The method comprises using a drive mechanism to provide a plurality of portions of material to a nozzle in order to generate a jet of the portions of material from the nozzle. At least some of the portions of material are at least partially coated in a contaminant. The jet of the portions of material is directed at a surface of a volume of liquid. An interaction occurs between the jet of the portions of material and the surface of the volume of liquid which causes at least some of the contaminant to detach from at least some of the portions of material.

The fact that the interaction between the jet of the portions of material and the surface of the volume of liquid causes at least some of the contaminant to detach from at least some of the portions of material, provides a method to remove contaminants from waste material which is cost effective, reliable and environmentally friendly. The method is cost effective because the method does not require large quantities of fuel, or expensive chemicals, to remove contaminant. The method is more effective than, for example, the use of detergents to remove contaminant. Moreover, the method is environmentally friendly, because it does not require large quantities of fuel or hazardous chemicals to remove contaminant.

The volume of liquid may be water, which provides a cheap, safe, readily available and highly effective medium in which to carry out the method.

The jet may comprise the plurality of portions of material in a stream of either gas or liquid. For example, the jet may comprise the plurality of portions of material in a stream of water.

The interaction between the jet of the portions of material and the surface of the volume of liquid may overcome an interfacial tension between the contaminant and at least some of the portions of material. Contaminant may be held to the surface of the portions of material by interfacial tension. The interaction between the jet of the portions of material and the surface of the volume of liquid may cause the portions of material to experience a shear stress (drag) which means that at least some of the contaminant may be sheared (or dragged) from the surface of a portion of the material.

The portions of material of the jet may be projected, using the drive mechanism, at the surface of the volume of liquid at a velocity which is above a threshold at which the interaction occurs.

The plurality of portions of material of the jet may have a velocity which is greater than a velocity of the surface of the volume of liquid. The surface of the volume of liquid may have a relatively stationary surface compared to the velocity of the portions of material. The significant momentum which the portions of material have when the portions of material hit the relatively stationary surface of the volume of liquid may promote shearing of the contaminant from the surface of at least some of the portions of the material.

The material may have a first density and the contaminant may have a second density. The difference between the first density and the second density may be used to separate the material and the contaminant into separate regions of the volume of liquid for removal. For example, the material may be steel and the contaminant oil, where the steel is more dense than the oil. In this example, if the liquid is water, the steel would sink towards the bottom of the volume of the water where the steel could be removed, while the oil would float to the surface of the water where the oil could be separately removed, thereby providing a method to separate the portions of material and the contaminant.

The method may further comprise holding the volume of liquid in a tank.

The tank may be cylindrical. An advantage of using a cylindrical tank is to encourage rotation of the liquid which encourages the contaminant to collect towards the centre of the tank. This may make it easier to remove the contaminant.

The tank may have a lower portion which is tapered. An advantage of using a tank where a lower portion is tapered is to prevent debris collecting around the edges of the tank.

The contaminant may be removed by pumping, or by using an industrial vacuum cleaner, which could be placed into an accumulation of the contaminant which has collected at the surface of the liquid.

A portion of the liquid may be removed through an overflow located at or near the surface of the volume of liquid. An advantage of removing a portion of liquid through an overflow at or near the surface is to allow a desired liquid level to be maintained in the tank. For example, by connecting the outlets of a chain of tanks, the liquid level can be substantially balanced throughout the chain of tanks.

The tank may be initially loaded with a plurality of portions of material. The tank may be initially loaded using one of: a hopper, a screw conveyor, a conveyor belt, or a pump.

At least some of the plurality of portions of material may be extracted from an outlet located at or near the base of the tank.

The extracted portions of material may be transferred to the nozzle using a drive mechanism. An advantage of transferring the extracted portions of material back to the nozzle is to provide a batch process where the portions of material makes multiple passes around the tank in order that a greater proportion of the contaminant may be removed than might be removed in a single pass around the tank.

The extracted portions of material may be transferred to a further nozzle on a further tank using a drive mechanism. An advantage of transferring extracted portions of material to a further nozzle on a further tank is to provide a continuous flow system. For example, material can be pumped from the outlet of a first tank to a nozzle above a second tank, and if desired, material from an outlet of the second tank can be pumped to a nozzle above a third tank, and so on, to create a chain of tanks with as many tanks as are necessary to achieve either complete removal of the contaminant from the material, or until the amount of contaminant remaining on the material is below a threshold.

The drive mechanism may be a pump. The pump may produce a flow rate of the portions of material of the jet which is above a threshold for the interaction to occur. The flow rate may be optimised for the level of contamination present on the portions of material, for example, a lower flow rate may be used for lightly contaminated material, whereas a higher flow rate may be used for highly contaminated material.

The flow rate produced by the pump may be in the range of 100 L $min^{-1}$ and 650 L $min^{-1}$, often 350 L $min^{-1}$ and 650 L $min^{-1}$, or 400 L $min^{-1}$ and 600 L $min^{-1}$. An advantage of the pump producing flow rates in these ranges is that a flow rate of the portions of material of the jet is produced which leads to the interaction occurring between the jet of the portions of material and the surface of the volume of liquid which causes at least some of the contaminant to detach from at least some of the portions of material.

The jet of the portions of material may be directed at the surface of the volume of liquid substantially perpendicular to the surface of the volume of liquid. Alternatively, the jet of the portions of material may be directed at an oblique angle with respect to the surface of the volume of liquid between the centre and an edge of the tank in order to promote rotation of the liquid which encourages contaminant that has been removed from the material to collect towards the centre of the surface of the volume of liquid which makes removal of contaminant from the volume of liquid easier, for example, allowing the contaminant to be removed using an industrial vacuum cleaner.

The oblique angle may be between 5° and 15°

The liquid may be heated which may help to either: reduce the viscosity of the contaminant which may help to improve removal of the contaminant; or allow the method to be used outside when the ambient temperature might otherwise cause the liquid to freeze.

An additive may be added to the volume of liquid. The additive may be a surface active agent which may encourage the contaminant to detach from the material.

The additive may be an anionic, cationic or non-ionic type surfactant. The additive may be one of the following surfactants: ASF/2, DGL4, DGL8, EBI, Oilgon, OSS or Q-clean Ultra. The surfactant may be selected to control foaming, so as to minimize excessive foaming.

The surfactant may be a surfactant that does not act as an emulsifier. An advantage of using a surfactant that does not act as an emulsifier is that the contaminant may not only be more easily detached from the material but also the detached contaminant may then be more easily separated from the volume of liquid. An example of a surfactant which could be used which does not act as an emulsifier is a glycolic surfactant, for instance, a glycol ether surfactant (such as OSS, available from Fluid Maintenance Solutions Limited).

The plurality of portions of material may include one or more of: swarf; millscale; or sand.

The contaminant may comprise two or more components. The process may remove multiple contaminants (for example, oil and cutting fluid) from a material simultaneously. This is particularly useful, for example, when processing millscale which is typically contaminated by multiple oils.

The contaminant may include one or more of: cutting fluid, oil, or grease.

According to a second aspect of the invention, there is provided a device to remove a contaminant from a material. The device comprises a nozzle, a drive mechanism and a tank. The drive mechanism is configured to provide a plurality of portions of material to a nozzle in order to generate a jet of the portions of material from the nozzle, where at least some of the portions of material are at least partially coated in a contaminant. The jet is configured to direct the portions of material at a surface of a volume of liquid held in the tank. An interaction occurs between the jet of the portions of material and the surface of the volume of liquid which causes at least some of the contaminant to detach from at least some of the portions of material.

The fact that the interaction between the jet of the portions of material and the surface of the volume of liquid causes at least some of the contaminant to detach from at least some of the portions of material, provides a way for the device to remove contaminants from waste material which is cost effective, reliable and environmentally friendly. Removing contaminants in this way is cost effective because large quantities of fuel, or expensive chemicals, are not required. Removing contaminants in this way is more effective than, for example, the use of detergents. Moreover, removing contaminants in this way is environmentally friendly, because it does not require large quantities of fuel or hazardous chemicals.

The volume of liquid may be water, which provides a cheap, safe, readily available and highly effective medium for carrying out the effect.

The jet may comprise the plurality of portions of material in a stream of either gas or liquid. For example, the jet may comprise the plurality of portions of material in a stream of water.

The interaction between the jet of the portions of material and the surface of the volume of liquid may overcome an interfacial tension between the contaminant and at least some of the portions of material. Contaminant may be held to the surface of the portions of material by interfacial tension. The interaction between the jet of the portions of material and the surface of the volume of liquid may cause the portions of material to experience a shear stress (drag) which means that at least some of the contaminant may be sheared (or dragged) from the surface of a portion of the material.

The drive mechanism may be configured to project the portions of material at the surface of the volume of liquid at a velocity which is above a threshold at which the interaction occurs.

The plurality of portions of material of the jet may have a velocity which is greater than a velocity of the surface of the volume of liquid. The surface of the volume of liquid may have a relatively stationary surface compared to the velocity of the portions of material. The significant momentum which the portions of material have when the portions of material hit the relatively stationary surface of the volume of liquid may promote shearing of the contaminant from the surface of at least some of the portions of the material.

The material may have a first density and the contaminant may have a second density. The difference between the first density and the second density may be used to separate the material and the contaminant into separate regions of the volume of liquid for removal. For example, the material may be steel and the contaminant oil, where the steel is more dense than the oil. In this example, if the liquid is water, the steel would sink towards the bottom of the volume of the water where the steel could be removed, while the oil would float to the surface of the water where the oil could be separately removed, allowing the portions of material and the contaminant to be separated.

The tank may be cylindrical. An advantage of using a cylindrical tank is to encourage rotation of the liquid which encourages the contaminant to collect towards the centre of the tank. This may make it easier to remove the contaminant.

The tank may have a lower portion which is tapered. An advantage of using a tank where a lower portion is tapered is to prevent debris collecting around the edges of the tank.

The device may comprise a pump, or an industrial vacuum cleaner, configured to remove the contaminant from the water.

The tank may comprise an overflow located at or near the surface of the volume of liquid. An advantage of having an overflow is that a portion of liquid may be removed through the overflow to allow a desired liquid level to be maintained in the tank. For example, by connecting the outlets of a chain of tanks, the liquid level can be substantially balanced throughout the chain of tanks.

The device may comprise a feed mechanism to load the tank initially with a plurality of portions of material. The feed mechanism may be one of: a hopper, a screw conveyor, a conveyor belt, or a pump.

The tank may comprise an outlet located at or near the base of the tank configured to allow at least some of the plurality of portions of material to be extracted.

The device may comprise a drive mechanism configured to transfer the extracted portions of material to the nozzle. An advantage of transferring the extracted portions of material back to the nozzle is to provide a batch process where the portions of material makes multiple passes around the tank in order that a greater proportion of the contaminant may be removed than might be removed in a single pass around the tank.

The device may comprise a drive mechanism configured to transfer the extracted portions of material to a further nozzle on a further tank. An advantage of transferring extracted portions of material to a further nozzle on a further tank is to provide a continuous flow system. For example, extracted material from a first tank can be pumped to a nozzle above a second tank, and if desired, extracted material from the second tank can be pumped to a nozzle on a third tank, and so on, to create a chain of tanks with as many tanks as are necessary to achieve either complete removal of the contaminant from the material, or until the amount of contaminant remaining on the material is below a threshold.

The drive mechanism may be a pump. The pump may be configured to produce a flow rate of the portions of material of the jet which is above a threshold for the interaction to occur. The flow rate may be optimised for the level of contamination present on the portions of material, for example, a lower flow rate may be used for lightly contaminated material, whereas a higher flow rate may be used for highly contaminated material.

The flow rate produced by the pump may be in the range of 100 L $min^{-}1$ and 650 L $min^{-}1$, often 350 L $min^{-}1$ and 650 L $min^{-}1$, or 400 L $min^{-}1$ and 600 L $min^{-1}$. An advantage of the pump producing flow rates in these ranges is that a flow rate of the portions of material of the jet is produced which leads to the interaction occurring between the jet of the portions of material and the surface of the volume of liquid which causes at least some of the contaminant to detach from at least some of the portions of material.

The jet may be configured to direct portions of material at the surface of the volume of liquid substantially perpendicular to the surface of the volume of liquid. Alternatively, the jet may be configured to direct portions of material at an oblique angle with respect to the surface of the volume of liquid between the centre and an edge of the tank in order to promote rotation of the liquid which encourages contaminant that has been removed from the material to collect towards the centre of the surface of the volume of liquid which makes removal of contaminant from the volume of liquid easier, for example, allowing the contaminant to be removed using an industrial vacuum cleaner.

The oblique angle may be between 5° and 15°

The device may comprise a heater configured to heat the liquid. Heating the liquid may help to either: reduce the viscosity of the contaminant which may help to improve removal of the contaminant; or allow the method to be used outside when the ambient temperature might otherwise cause the liquid to freeze.

The volume of liquid may comprise an additive. The additive may be a surface active agent which may encourage the contaminant to detach from the material.

The additive may be an anionic, cationic or non-ionic type surfactant. The additive may be one of the following surfactants: ASF/2, DGL4, DGL8, EBI, Oilgon, OSS or Q-clean Ultra. The surfactant may be selected to control foaming, so as to minimize excessive foaming.

The surfactant may be a surfactant that does not act as an emulsifier. An advantage of using a surfactant that does not act as an emulsifier is that the contaminant may not only be more easily detached from the material but also the detached contaminant may then be more easily separated from the volume of liquid. An example of a surfactant which could be used which does not act as an emulsifier is a glycolic surfactant, for instance, a glycol ether surfactant (such as OSS, available from Fluid Maintenance Solutions Limited).

The plurality of portions of material may include one or more of: swarf; millscale; or sand.

The contaminant may comprise two or more components. The process may remove multiple contaminants (for example, oil and cutting fluid) from a material simultaneously. This is particularly useful, for example, when processing millscale which is typically contaminated by multiple oils.

The contaminant may include one or more of: cutting fluid, oil, or grease.

BRIEF DESCRIPTION OF THE DRAWINGS

The present invention shall now be described, by way of example only, with reference to the accompanying drawings, in which.

DETAILED DESCRIPTION

Figure 1:
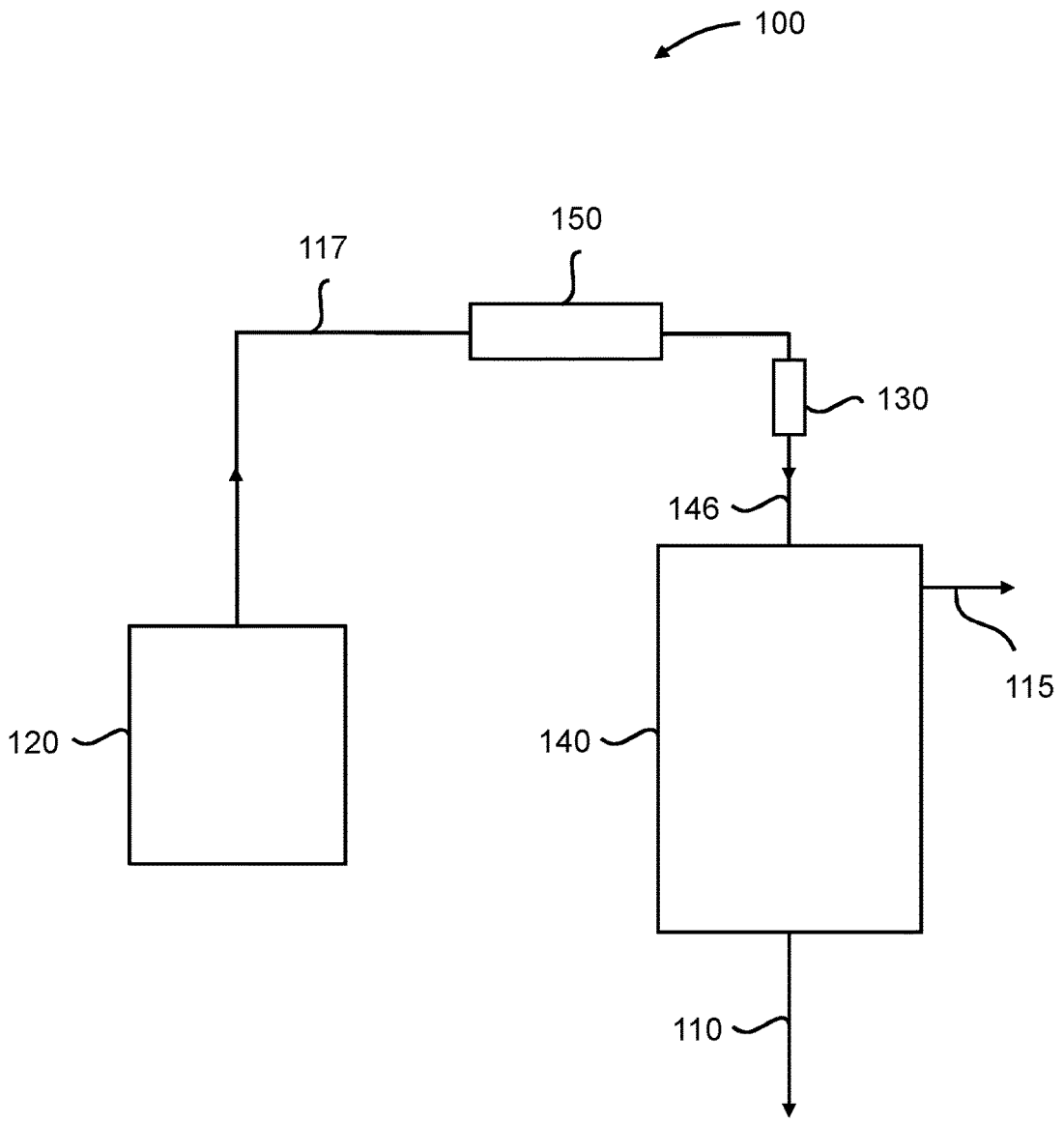
FIG. 1 is a schematic of a device to remove a contaminant from a material according to an embodiment of the invention.

FIG. 1 illustrates a device 100 to remove a contaminant from a material in order to produce material with little or no contaminant that can be reused or recycled. In this example, the material is swarf (waste metal shavings) produced as a by-product of machining a metal block and the contaminant is oil 115 which was used as a lubricant during the machining process which produced the swarf and which is now coating the outside of the swarf resulting in contaminated swarf 117.

A drive mechanism 150 receives contaminated swarf 117 from supply 120. The drive mechanism 150 uses pressurized air or a high-speed wheel to propel a jet of the contaminated swarf 117 through nozzle 130 at high speed.

Tank 140 is filled with water and the nozzle 130 is located above, and spaced apart from, the surface of the water in the tank 140. The nozzle 130 directs the jet 146 of the contaminated swarf 117 at the surface of the water.

An interaction between the stream 146 of the contaminated swarf 117 and the surface of the water removes at least a portion of the oil 115 from the surface of the swarf. The oil 115 is held to the surface of the swarf by interfacial tension. The stream of the contaminated swarf 117 is travelling at high speed when the stream 146 hits the surface of the water. The contaminated swarf 117 experiences a shear stress (drag) which means that the oil 115 is sheared (or dragged) from the surface of the swarf. Once free from the swarf, the oil 115 will float to the surface of the water because the oil 115 is less dense that the water. In this way, the oil 115 collects at the surface where the oil 115 can be removed.

The swarf collects at the bottom of the tank 140 with some, if not all, of the oil 115 removed. The tank 140 has an outlet through which swarf 110 can be removed from the tank 140 for further oil removal (if necessary), further processing, reuse or recycling.

In some cases, passing the contaminated swarf 117 through a single tank 140 will be enough to remove all of the oil 115 from the contaminated swarf 117. However, it is often necessary for contaminated swarf 117 to make multiple passes through a tank 140, where a portion of the oil 115 is removed on each pass through a tank 140, in order to ensure that after the multiple passes are complete all of the oil 115 is removed from the contaminated swarf 117 or at least a desired amount of the oil 115 is removed from the contaminated swarf 117.

A device can be configured in a number of ways to allow the contaminated swarf 117 to make multiple passes through a tank 140. A device can be configured to perform a batch process where the contaminated swarf 117 makes multiple passes through a single tank. Alternatively, a device can be configured for a continuous flow process where the contaminated swarf 117 passes through a sequence of two or more identical, or different, tanks.

Figure 2:
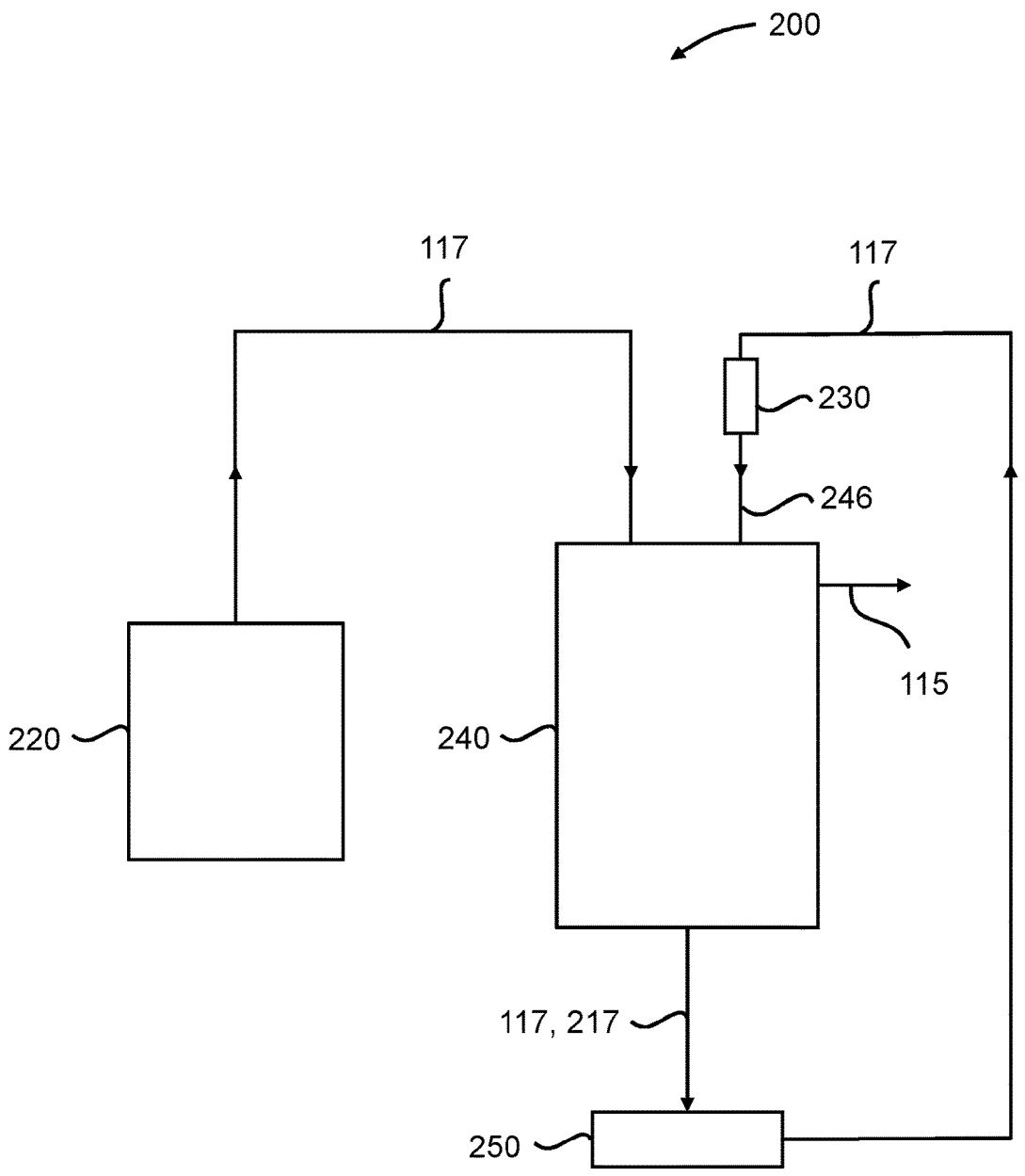
FIG. 2 is a schematic of a device to remove a contaminant from a material in a batch process according to an embodiment of the invention.

FIG. 2 shows a device 200 which can be used to clean contaminated swarf 117 in a batch process by having a quantity of still contaminated swarf 217 make multiple passes through a single tank 140 with portions of the oil 115 being removed on each pass.

In this example, contaminated swarf 117 is loaded into hopper 220 and a screw conveyor transfers a quantity of the contaminated swarf 117 into tank 240 containing water. Once the quantity of contaminated swarf 117 has been transferred into the tank 240, the screw conveyor is stopped so that no further contaminated swarf 117 is transferred into the tank 240.

The contaminated swarf 117 tends to sink and collect at the bottom of the tank 240, because the swarf is more dense than the water. There is an outlet at the bottom of the tank 240, and the outlet is connected to a pump 250.

When the pump 250 is activated, a mixture of contaminated swarf 117 and water from the bottom of the tank 240 will be pumped through the outlet, along a pipe to a nozzle 230. The nozzle 230 forms a jet 246 of contaminated swarf 117 which is propelled at high speed towards the surface of the water. Propelling the contaminated swarf 117 at high speed towards the surface of the water leads to the occurrence of the interaction (described in FIG. 1) removing part, but not all, of the oil 115 from the surface of the swarf. The still contaminated swarf 217 collects at the bottom of the tank 240 and any oil 115 removed from the contaminated swarf 117 floats to the surface of the water.

This process is repeated for as long as the pump 250 is activated so that the contaminated swarf makes multiple passes around the tank 240. The process of pumping swarf around the tank 240 can be repeated until all the oil 115 has been removed from the swarf so that the swarf is completely free from oil, or otherwise the process can be continued until a sufficient quantity of oil 115 has been removed so that the swarf is sufficiently clean.

Once all of the oil 115 has been removed from the swarf, or once a sufficient quantity of oil 115 has been removed from the swarf, the decontaminated swarf is removed from the tank 240, for example, by directing the stream 246 from the second nozzle 230 into a sieve to collect the decontaminated swarf and remove any residual water.

Figure 3:
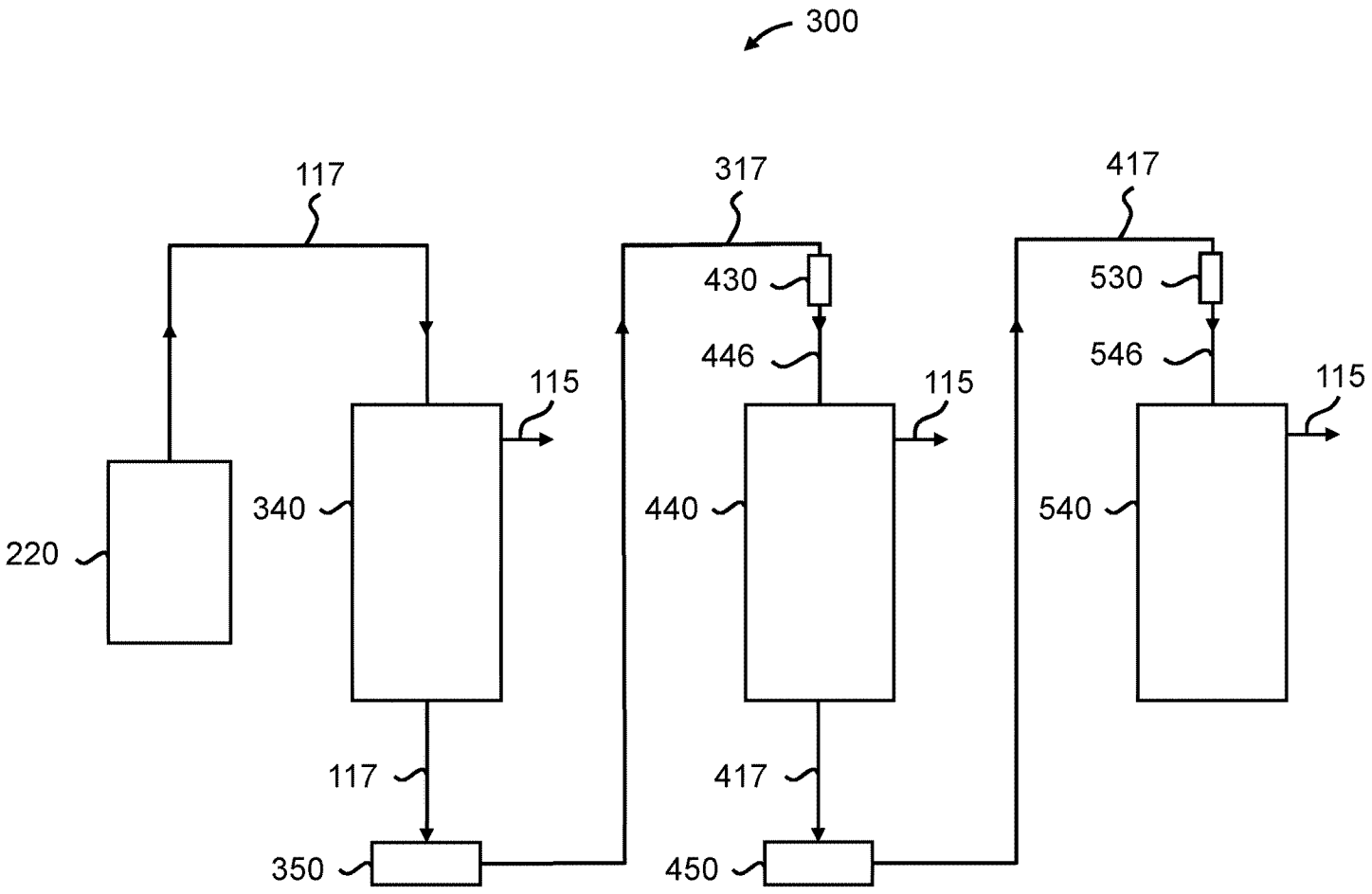
FIG. 3 is a schematic of a device to remove a contaminant from a material in a continuous flow process according to an embodiment of the invention.

FIG. 3 shows a device 300 to clean contaminated swarf 117 in a continuous flow process where, in this example, the contaminated swarf 117 passes through a sequence of three tanks 340, 440 and 540.

A supply of contaminated swarf 117 is transferred continuously from a hopper 220, using a screw conveyor, into the first tank 340 containing water.

The contaminated swarf 117 tends to sink and collect at the bottom of the tank 340, because the swarf is more dense than the water. There is an outlet at the bottom of the tank 340, and the outlet is connected to a pump 350.

A pump 350 pumps the mixture of contaminated swarf 117 and water from the outlet of the first tank 340, through a transfer pipe to a nozzle 430 above the second tank 440. The nozzle 430 forms jet 446 of the contaminated swarf 117 which is propelled at high speed towards the surface of water in the second tank 440, separating part of the oil 115 that was coating the contaminated swarf 117. The separated part of the oil 115 floats to the surface of the second tank 440 while the still contaminated swarf 417, which is still partially contaminated with oil 115, sinks to the bottom of the second tank 440.

A pump 450 pumps the still contaminated swarf 417 from an outlet of the second tank 440, through a transfer pipe to a third nozzle 530 above the third tank 540. The nozzle 530 forms a jet 546 of the still contaminated swarf 417 which is propelled at high speed towards the surface of water in the third tank 540, separating the rest of the oil 115 that was coating the still contaminated swarf 417. The separated part of the oil 115 floats to the surface of the third tank 540 and the now clean swarf sinks to the bottom of the third tank 540 where the now clean swarf can be extracted for reuse or recycling using, for example, a screw conveyor.

Although the invention has been described in the above examples as having certain preferred features, the skilled person will appreciate that various modifications could be made without departing from the scope of the appended claims.

Although FIGS. 2 and 3 have been described as using a screw conveyor to supply contaminated swarf 117 to tank 240 at the start of the process in FIG. 2 or to the first tank 340 in FIG. 3, the contaminated swarf 117 could be supplied in other ways, for example, the contaminated swarf 117 could be supplied from a hopper placed above a tank and the contaminated swarf 117 could be fed to the tank under gravity, or the contaminated swarf 117 could be supplied by a conveyor belt, or using a pump.

Alternatively, the contaminated swarf 117 could be supplied to tank 240 at the start of the process in FIG. 2 or to the first tank 340 in FIG. 3 using the apparatus shown in FIG. 1.

Some or all of the tanks may have overflows at or near the surface of the water. Some or all of the overflows may be connected together in order to substantially balance the water level between the tanks. The overflow of the last tank of a chain of tanks may be fed into the first tank of the chain of tanks. A filter may be placed over one or more of the overflows to prevent debris passing through the overflows and being transferred to other tanks. For example, each of the tanks 340, 440 and 540 may have overflows located at or near the surface of the water in each of the tanks. By connecting overflows on tanks 340, 440 and 540 with a pipe, water may be exchanged between the tanks 340, 440 and 540 in order to substantially balance the water level in each of the tanks 340, 440 and 540.

A final tank in a chain of tanks may have a ballcock to control filling of the final tank and to increase the water level in any tank to which the final tank is connected via overflows.

Although not shown in FIG. 2, the device 200 may have an outlet, such as a valve, placed somewhere on the return pipe, outlet, or tank 140, to allow swarf to be removed from the tank 140 at the end of the process.

Although the description of FIG. 3 describes extraction of the clean swarf using a screw conveyor, the clean swarf could be extracted in other ways, such as a valve, or an outlet on the tank 540.

The nozzle may be arranged to direct the jet at an oblique angle (such as an angle of between 5° and 15°) with respect to the surface of the water between the centre and an edge of the tank to encourage rotation of the water. Rotation of the water may encourage the oil 115 to collect towards the centre of the tank.

Although FIG. 3 shows a continuous flow process using three tanks, any number of tanks could be used, for example, two tanks, or four tanks. The number of tanks is determined by how easy it is to remove the oil 115 from the swarf 110, by how much oil 115 is coating the contaminated swarf 117, and by how much oil 115 it is desired to remove from the contaminated swarf 117.

Tanks may be cylindrical to encourage rotation of the liquid which encourages the contaminant to collect towards the centre of the tank, which can make removal of the contaminant easier. Alternatively, tanks may have a lower portion which is tapered to prevent debris collecting around the edges of the tank.

All of the tanks in a continuous flow process could be the same, for example, all of the tanks could have a tapered lower portion, or all of the tanks could be cylindrical. Alternatively, there could be a selection of tapered and cylindrical tanks.

In an embodiment, the process may use four tanks, which has sometimes been found to be an advantageous configuration for cleaning contaminant from swarf and other materials. A first tank (like tank 340) receives contaminated swarf 117 from a screw conveyor. The output of the first tank is pumped into a nozzle above a second tank (like tank 440), the output of the second tank is pumped into a nozzle above a third tank (also like tank 440) and the output of the third tank is pumped into a nozzle above a fourth setting tank (like tank 540) ready for removal of the decontaminated swarf.

Any, or all, of the tanks 140, 340, 440 and 540 may incorporate a heater configured to heat the water which may reduce the viscosity of the oil 115 which may make removal of the oil 115 easier, or may allow the process to be used outside in cold weather where the water might otherwise freeze.

The nozzle on one or more of the tanks may comprise a manifold (for example, a manifold with six openings), or some other device to reduce the level of agitation in the tank which may help settling of swarf to the bottom of a tank. A nozzle comprising a manifold may be particularly beneficial in a settling tank, such as tank 540 in FIG. 3.

An additive, such as a surface active agent, may be added to the water to aid detachment of the contaminant.

The additive may be an anionic, cationic or non-ionic type surfactant. The additive may be one of the following surfactants: ASF/2, DGL4, DGL8, EBI, Oilgon, OSS or Q-clean Ultra. The surfactant may be selected to control foaming, so as to minimize excessive foaming.

The surfactant may be a surfactant that does not act as an emulsifier. An advantage of using a surfactant that does not act as an emulsifier is that the contaminant may not only be more easily detached from the material but also the detached contaminant may then be more easily separated from the volume of liquid. An example of a surfactant which could be used which does not act as an emulsifier is a glycolic surfactant, for instance, a glycol ether surfactant (such as OSS, available from Fluid Maintenance Solutions Limited).

One or more of the tanks may incorporate a port for adding an additive to the water.

Although the invention has been described in terms of cleaning swarf contaminated with oil, the skilled person will appreciate that the invention can be used to remove any kind of contaminant from any kind of material.

For example, the material could be any kind of metal, such as steel, aluminium, titanium or nickel.

Additionally, the material could be millscale, or sand, or any other kind of contaminated material.

The contaminant could be any kind of cutting fluid, oil, lubricant, and/or grease.

The invention may be used to separate oil from oil sand, in which case, the material would be oil and the contaminant would be sand.

The oil 115 may collect at the surface where the oil 115 can be removed, for example, using an industrial vacuum cleaner.

The contaminant may comprises two or more components which are to be removed simultaneously.

The invention will work with any particle size of material which can be handled by a pump or pumps used in the process. Where the particle size is larger than can be handled by a pump, the material may pre-crushed (for example, by hammer milling) to reduce the particle size.

The decontaminated material may be subjected to further processing after being removed from a tank. For example, the decontaminated material may be passed through a centrifuge to separate any residual water before the decontaminated material is dried in an oven. The contaminant may be subject to further processing before reuse or recycling.

In an example, when removing a contaminant in the form of process oil from millscale, a suitable method which removes all, or at least a sufficient quantity, of the process oil from the millscale has been found to involve using three tanks in a continuous flow process according to FIG. 3, or three passes around a tank in a batch process according to FIG. 2, using a pump capable of providing a nominal flow rate of 600 L $min^{-1}$, or a pump capable of providing a nominal flow rate of 400 L $min^{-1}$.

The invention claimed is:

1. A method to remove a contaminant from a material, the method comprising:

using a drive mechanism to provide a plurality of portions of material to a nozzle in order to generate a jet of the portions of material from the nozzle, wherein at least some of the portions of material are at least partially coated in a contaminant; and directing the jet of the portions of material at a surface of a volume of liquid, wherein an interaction between the jet of the portions of material and the surface of the volume of liquid causes at least some of the contaminant to detach from at least some of the portions of material.

2. The method of claim 1, wherein the interaction between the jet of the portions of material and the surface of the volume of liquid overcomes an interfacial tension between the contaminant and at least some of the portions of material.

3. The method of either of claim 1, wherein the plurality of portions of material of the jet have a velocity which is greater than a velocity of the surface of the liquid.

4. The method of claim 1, wherein the material has a first density and the contaminant has a second density, and the difference between the first density and the second density is used to separate the material and the contaminant into separate regions of the volume of liquid for removal.

5. The method of claim 1, further comprising holding the volume of liquid in a tank.

6. The method of claim 5, further comprising extracting at least some of the plurality of portions of material from an outlet located at or near the base of the tank.

7. The method of claim 6, further comprising using a drive mechanism to transfer the extracted material to the nozzle.

8. The method of claim 6, further comprising using a drive mechanism to transfer the extracted material to a further nozzle on a further tank.

9. The method of claim 5, further comprising directing the jet of the portions of material at an oblique angle with respect to the surface of the volume of liquid between the center and an edge of the tank in order to promote rotation of the liquid.

10. The method of claim 1, further comprising removing the contaminant from the surface of the volume of liquid.

11. The method of claim 1, further comprising adding a surface active agent to the volume of liquid to encourage the contaminant to detach from the material.

12. The method of claim 1, wherein the contaminant comprises two or more components.

* * * * *